US005353672A

United States Patent [19]

Stewart

[11] Patent Number: 5,353,672

[45] Date of Patent: Oct. 11, 1994

[54] COLLAPSIBLE GUITAR WITH QUICK DISCONNECT NECK AND SUBMERGED STRING TUNNELS

[75] Inventor: Leland W. Stewart, Swansboro, N.C.

[73] Assignee: Stewart Guitar Co., Swansboro, N.C.

[21] Appl. No.: 9,116

[22] Filed: Jan. 26, 1993

[51] Int. Cl.[5] ..... G10D 3/00

[52] U.S. Cl. ..... 84/291; 84/293; 84/297 R; 84/267

[58] Field of Search ..... 84/267, 291, 292, 293, 84/297 R, 298, 299, 307, 308, 309

[56] References Cited

U.S. PATENT DOCUMENTS

| | | | |
|---|---|---|---|
| 4,073,211 | 2/1978 | Jorgensen | 84/291 |
| 4,191,085 | 3/1980 | Litwin | 84/293 |
| 4,911,057 | 3/1990 | Fishman | 84/297 R |
| 4,939,970 | 7/1990 | Hoshino et al. | 84/291 |

OTHER PUBLICATIONS

Erlewine, *Guitar Player Repair Guide*, "How to Set Up, Maintain, and Repair Electrics and Acoustics," p. 96.

Denyer, *The Guitar Handbook*, 12th Ed., Aug. 1989, p. 165.

*Primary Examiner*—Michael L. Gellner

*Assistant Examiner*—Cassandra C. Spyrou

*Attorney, Agent, or Firm*—Wegner, Cantor, Mueller and Player

[57] ABSTRACT

A musical instrument includes a neck, a body and a quick-release neck clamp adjacent the neck and the body. The quick-release neck clamp includes a neck plate attached to the neck, a body assembly with an elongated body assembly pocket attached to the body and at least one releasable fastener adjacent both the neck plate and the body assembly. The body includes a front surface formed on the body that defines a front surface plane, and the elongated body assembly pocket defines an axis that is parallel to the front surface plane.

29 Claims, 6 Drawing Sheets

COLLAPSIBLE GUITAR WITH QUICK DISCONNECT NECK AND SUBMERGED STRING TUNNELS

FIELD OF THE INVENTION

The present invention relates to stringed musical instruments and more particularly to guitars, either acoustical or electrical, that look, feel, and play like a typical full sized instrument but can be quickly disassembled and stowed in a small space, for compact storage and/or easy discrete transportation. Stringed instruments constructed according to the present invention can be readily reassembled without tools, special skills or even the necessity for re-tuning. A full-size guitar according to the present invention can be rendered so compact that it can be secreted in a traditional briefcase or attache case, enabling a traveler of conservative appearance to carry a guitar unnoticed.

BACKGROUND OF THE INVENTION

A conventional stringed instrument is typically constructed in such a manner that the neck of the instrument is permanently attached to the body. For example, some guitars have integral necks and others have necks that are bolted onto the body of the guitar as a single piece. Although such bolt-on necks are theoretically detachable, due to the critical alignment requirements between the neck of a guitar and the body, as well as the time required to loosen both the strings and the bolts, these "bolt-on" guitar necks are for all practical purposes permanently attached.

Thus, due to the fixed presence of the neck, the length of conventional guitars presents a major problem with respect to transportation and storage. Also, the volumetric bulk of a conventional guitar additionally causes great difficulties, particularly with regard to commercial carriers such as airlines. Until now, there have been only two practical ways to transport guitars by commercial transportation. One way was to hand carry the guitar aboard the vehicle and gamble on having sufficient storage space. The alternative has previously been to utilize a massive reinforced shipping case that provides sufficient protection from the rough handling checked baggage typically receives. For the typical traveler neither of the above described options is entirely satisfactory. Moreover, in addition to the bulk and the resulting extra luggage, many travelers object to the "appearance" presented by a traveler carrying a guitar aboard a commercial carrier.

Although there are several commercially produced "travel guitars" currently available, these are merely slightly scaled-down versions of full size guitars. Scaled-down prior art travel guitars are still relatively large and are almost as inconvenient to transport as regular full-size guitars.

It has been proposed in the past to design a guitar so as to be collapsible, to a configuration that is smaller in size, in order to make it easier to transport and more convenient to store. One approach has been to construct the guitar with a foldable neck or fingerboard portion. A major disadvantage with such guitars is that folding in order to collapse the guitar usually requires that the guitar be completely re-tuned when erected. For example, a representative prior art embodiment is disclosed in U.S. Pat. No. 4,073,211, to Jorgensen, hereby expressly incorporated by reference. The Jorgensen design utilizes a hinged arrangement with a shaped recess in the back of the instrument into which the neck swings when it is folded into the collapsed position. Although folding the Jorgensen neck does result in a more compact overall size, the strings of the Jorgensen guitar must be completely disconnected prior to folding. Further, the bridge of the Jorgensen guitar must be detached from the body of the guitar for storage purposes. Furthermore, to maintain the desirable full scale-length fret board (of from 24 to 25½ inches), the Jorgensen guitar still requires a relatively long storage space even in the folded configuration because the neck is folded and stowed parallel to its deployed axis.

Similarly, U.S. Pat. No. 4,111,093, to Field, hereby expressly incorporated by reference, also attempts to reduce the size of a guitar by folding the neck. The Field guitar employs a complex system of gears and rollers so that the tension of the strings can be relaxed in order to permit the neck to be folded. Additionally, the Field guitar employs a spring-loaded pin for the purpose of locking the neck in an extended position when the instrument is to be played. A significant disadvantage with the Field guitar is that the mechanical complexity of its precision linkages adds to the cost of manufacturing. Thus, the Field guitar is substantially more expensive than a fixed neck guitar of comparable musical quality. Further, the functional reliability of the guitar is lowered by both the complexity of the mechanism itself as well as the resulting weakening of the body caused by mounting the mechanism. Furthermore, the presence of this complicated mechanism adversely affects the tonal characteristics of the instrument. As with the Jorgensen guitar, the Field guitar still requires a relatively long storage space because, although the neck is folded, it is stowed parallel to its deployed axis. Thus, the above discussed prior art folding guitars do not provide the ultimate compact travel guitar greatly desired by guitar owners.

Another type of prior art folding guitar includes radially collapsible body sections. An example of such a prior art guitar is described in U.S. Pat. No. 4,686,882, to Shaw, hereby expressly incorporated by reference. The Shaw guitar has a main body to which laterally moveable wing-like sections are connected. These wing sections are provided with expander mechanisms which include a threaded stem projecting through one wall in order to allow the musician to manually expand the wings into their playing position. In addition, the Shaw guitar also has a neck portion which is folded by means of a hinge on the top of the instrument body. However, although folding the Shaw guitar does reduce its length, the front-to-back thickness of the Shaw guitar is actually increased by folding the neck because the radially collapsing wings preclude the presence of a recess in the back of the guitar into which the neck could swing. As with the Jorgensen and Field guitars, a relatively long storage space is still needed because the Shaw neck is also folded and stowed parallel to its deployed axis, albeit against the front of the body. Again, a major disadvantage with such guitars is that folding the neck in order to collapse the guitar requires that the guitar be re-tuned when erected. Another disadvantage with such laterally collapsible wing section prior art guitars is that they are limited to bodies of a particular shape (i.e., the wings must be generally triangular in form so that the guitar is collapsible). This design constraint severely limits the choice of body styles and designs. In addition, the complex mechanical mechanisms inherent to such radially collapsible wings make the guitar more expensive, tend to adversely affect the tonal characteristics of the instrument and lower the functional reliability of the instrument.

Still other prior art guitars are composed of separate sections or parts which may be joined together in a modular manner to yield a musical instrument in unitary form. An example of such a prior art guitar is disclosed in U.S. Pat. No. 4,254,683, to Nulman, hereby expressly incorporated by reference. The Nulman guitar includes two portions, a neck with minor body portion and a major body section. The major body section has a recess, or socket, which receives the minor body portion to which the neck is connected. When assembled, the upper surfaces of the main body and the fingerboard define substantially parallel planes. However, such prior art guitars provide only a limited degree of reduced dimensional size, are difficult to assemble, requires special tools and a certain amount of manual dexterity. Design flexibility is again severely limited.

SUMMARY OF THE INVENTION

The present invention is directed to providing stringed musical instruments, particularly guitars, either acoustical or electrical, that look, feel, and play like a typical full sized instrument but can be quickly disassembled and stored in a small space, for compact storage and/or easy discrete transportation. Stringed instruments constructed according to the present invention can be readily reassembled without tools, special skills or even completely re-tuning. A full-size electric guitar according to the present invention can be rendered so compact that it can be secreted in a traditional-type briefcase or attache case, enabling a traveler of conservative appearance to carry the guitar essentially undetected.

The features of the present invention that allow stringed instrument designs to achieve a uniquely small storage size are a quick-release removable neck and an optional neck storage channel within the body of the guitar. The quick-release removable neck according to the present invention is easily removed from the body of the guitar without de-tuning the strings and without the necessity of using any hand tools such as screwdrivers, allen wrenches or pliers. The neck is easily removed from and reattached to the body of the guitar by a quick connect-disconnect neck clamp. The quick connect-disconnect neck clamp includes two major assemblies, the neck plate and the body assembly and will hereinafter be referred to as a quick-release neck clamp. Once removed, the neck can then be stored in a cavity which is arranged diagonally within, and integral to, the back of the body of the guitar. In order to reduce the length of the removable neck, the tuning devices are advantageously located on the rear end portion of the guitar body, instead of the more traditional location at the top of the neck. In addition, in order to ruggedize the design and reduce its size still further, the strings are advantageously routed from the bridge to the tuning devices through a plurality of string tunnels which enclose a portion of the strings.

A principle object of the invention is to provide a stringed instrument that, when assembled, becomes a full scale-length instrument of the same size and shape as customary instruments, but which, when not in use, can have its neck easily removed and stowed, with or apart from the body, in a small compact space for storage or discrete transportation.

Another object of the invention is to provide an improved stringed instrument having a neck which can be removed from and then reattached to the instrument without first removing, detuning or even loosening the strings.

Another object of the invention is to provide an improved stringed instrument that is economical to manufacture.

Another object of the invention is to provide a stringed instrument having a reduced sized when dissembled so as to provide additional flexibility of design in order to achieve numerous unusual designer body styles.

Another object of the invention is to provide a stringed musical instrument with a quick-release removable neck that does not required unusual dexterity or any special skills or tools to assemble or dissemble.

It is still another object of the present invention to provide a removable neck stringed instrument where the acoustical properties such as tone and sustain are not substantially affected by the removability of the neck.

A further object of the invention is to provide a more rigid connection between the neck and the body of a musical instrument in order to enhance the sustain quality of the instrument.

A further object of the invention is to provide a means of repeatable self-alignment of interchangeable necks with the body of a stringed instrument.

A further object of the stringed musical instrument is to provide a removable neck that can be detached and reattached quickly.

A further object is to provide a stringed musical instrument which the removed neck can be stored partially within a storage cavity which is located within the body of the instrument.

A further object is to provide a compact stringed musical instrument which when assembled has a full-scale string length comparable to other traditional musical instruments of the same type.

A further object of the invention is to provide a means to prevent the quick-release removable neck from accidentally releasing thereby preventing harm to persons handling the instrument or damage to the instrument.

A further object of the invention is to provide a stringed musical instrument in which the neck and body are so easy to separate that, when the instrument is not being used, a musician will be encouraged to customarily remove the neck, thereby releasing tension from the neck and body, thus prolonging the life of the strings and precluding warpage of the neck.

Other objects, advantages and features of the present invention will be more readily appreciated and understood when considered in conjunction with the following detailed description as drawings.

BRIEF DESCRIPTION OF THE DRAWINGS

These and other aspects of the invention are apparent from the following drawings, in which.

DETAILED DESCRIPTION OF THE INVENTION

It should be noted that while a guitar is shown and described, the invention is applicable to all stringed instruments. For example, banjos, violins and bass fiddles would benefit from a quick-release neck clamp according to the invention.

Figure 1:
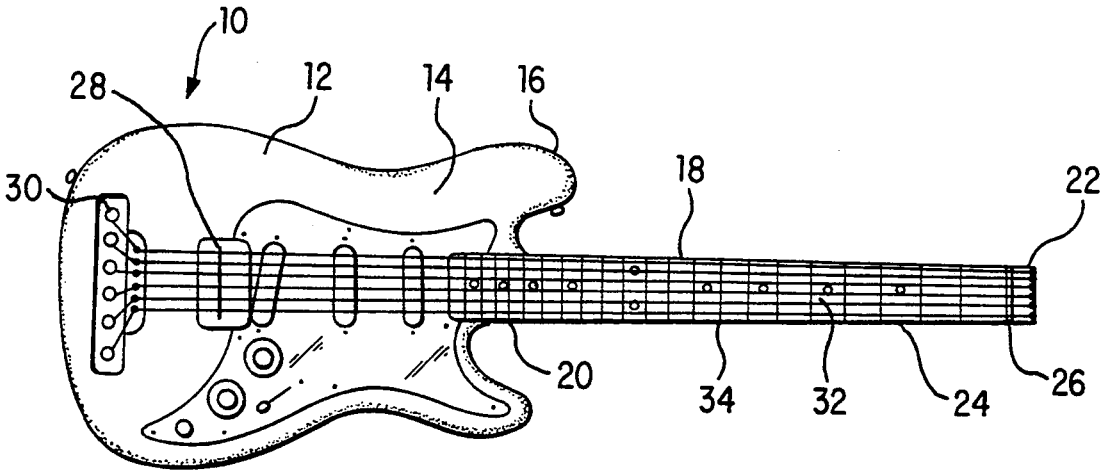
FIG. 1 illustrates a top plan view of a guitar according to the present invention in a fully assembled state.

Referring to the drawings, FIG. 1 shows a guitar with a quick-release neck clamp incorporating various features of the present invention. The guitar 10 comprises a body 12 having a forward surface 14 and a rearguard surface 16. Preferably, the body 12 is fabricated of wood. However, various fabricating materials can be utilized such as plastics and composites. Further, whereas the illustrated body 12 is depicted in FIG. 3 as being fabricated from a single piece of wood, the body need not be integrally formed, and also can define an acoustical cavity (not shown) therein such that the guitar is commonly referred to as a "hollow body" guitar.

Again referring to FIG. 1, the guitar 10 also comprises a neck 18 having a proximal end portion 20 for engaging the body 12 such that the neck 18 extends outwardly from the body 12. The longitudinal orientation of the neck 18 when it is connected to the body 12 defines a longitudinal axis. The neck 18 also defines a distal end portion 22 which provides the anchoring point for the strings 24. As will be understood by those of ordinary skill in the art, the strings 24 of the guitar are strung from the nut 26, over the neck 18 and body 12, across the bridge 28 to tuning devices 30 mounted on the body 12 such that the strings 24 are disposed a selected distance above the finger board 32 of the neck 18 and the frets 34 which are mounted on the finger board 32.

Figure 2:
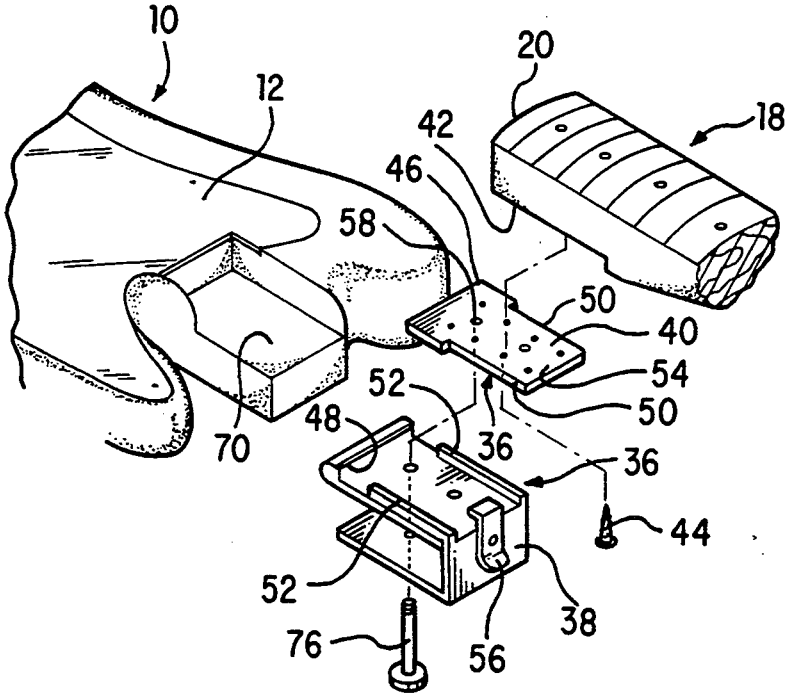
FIG. 2 illustrates a partial exploded prospective view of a quick-release neck clamp according to the present invention.

Referring now to FIG. 2, the neck 18 is removed from and reattached to the guitar body 12, basically by connector 36. Connector 36 includes the body assembly 38 and the neck plate 40. The neck plate 40 is fastened to the neck heel 42 on the bottom (i.e. non-fretted) side of the neck 18 with a plurality of wood screws 44. Some of the functions the neck plate 40 provides are described by the following. Plate heel 46 provides the initial anchoring and alignment point for positioning the neck for attachment. Plate heel 46 is inserted into the body assembly pocket 48 and the neck 18 is lowered into playing position. The alignment edges 50 of neck plate 40, in conjunction with alignment rails 52 of body assembly 38, ensure that the neck 18 is properly aligned with respect to the guitar body each time the neck is attached. Attachment edge 54 is the initial attachment point of the neck to the guitar and once initially attached, the neck 18 is held in place by latch assembly 56 engaging attachment edge 54. The attachment edge 54 must be able to withstand the bending and shear forces placed on it from the latch 56 as a result of the tension of the guitar strings. Releasable fastener receptacles 58 are the primary final securing devices, which hold the neck plate 40 tightly to the guitar body assembly 38 when the instrument is fully assembled for playing, or while not otherwise disassembled. Although the neck plate 40 is depicted in FIG. 2 as a separate steel plate joined to the neck 18 with wood screws 44, the functions provided by the neck plate 40 could be integrated into the design of the neck itself if the neck were to be constructed of materials which provided sufficient strength in the critical areas of attachment to the body assembly 38. If the neck were to be constructed out of materials such as metal alloys, high density polymers or a composite combination of wood and metal, the operative surfaces and features of neck plate 40 and body assembly 38 could be directly machined into the neck and body respectively.

Figure 3:
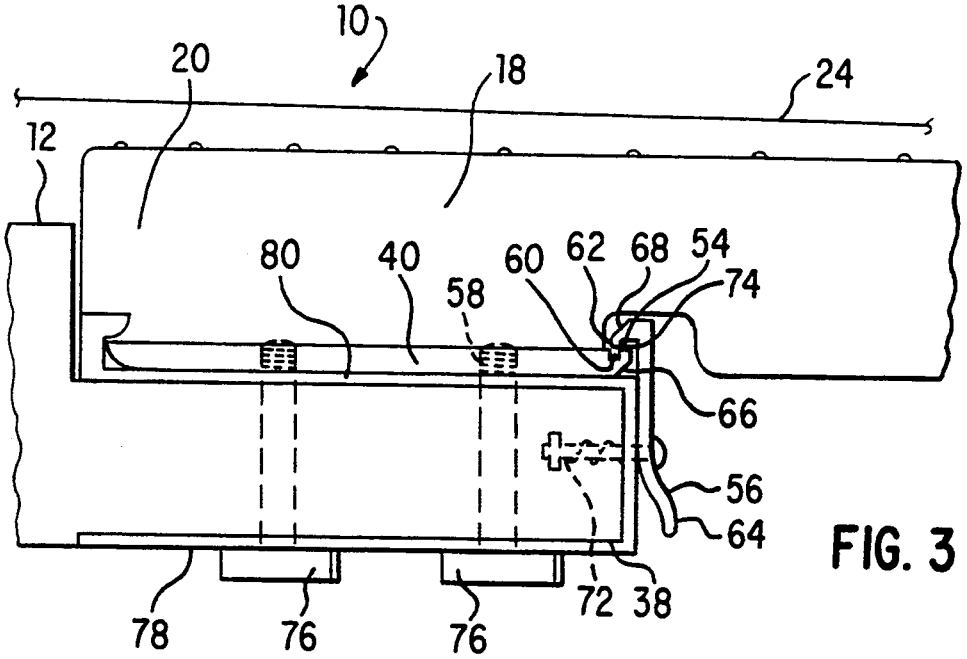
FIG. 3 illustrates a partial cross sectional view of a quick-release neck clamp according to the present invention.

Referring now to FIG. 3, safety groove 60 is an elongated indentation in the neck plate 40 which allows a raised safety lip 62 on the bottom inside edge of the latch 56 to snap into safety groove 60. When the latch 56 is engaged, and the primary securing points are not engaged, the tension from the guitar strings 24 attempts to pull the neck plate 40 away from the guitar body assembly 38. Latch 56 is held in engagement with neck plate 40 by the restorative force exerted by spring 72. In addition, the safety lip 62 seated in the safety groove 60 helps to enhance safety by preventing latch 56 from slipping off the neck plate 40 and accidentally releasing the neck 18. Only by holding neck 18 down into the playing position and simultaneously depressing the latch 56 at depression point 64, against the restorative force of spring 72, is the safety lip 62 free to move out of the safety groove 60 of neck plate 40. Consequently neck 18 is released and is thereby free to move away from the guitar for disassembly. Plate strike edge 66 on neck plate 40 is a tapered edge used in conjunction with the latch 56 strike edge 68 and is described with the body assembly 38 below.

Referring again to FIG. 2, body assembly 38 is attached to the body of the guitar 10 by sliding onto the neck pocket area 70. The body assembly 38 is fastened to the guitar by a plurality of screws not shown. Body assembly pocket 48 is the initial anchoring and alignment point for the neck plate 40. Body assembly pocket 48 is a grooved shaped opening that plate heel 46 is inserted into. Alignment rails 52 ensure that alignment edge 50 of neck plate 40, and consequently neck 18, is always positioned correctly when lowered for attachment into the playing position.

Referring now to FIG. 3, latch 56 provides the initial restraint of the neck plate 40 to the body assembly 38. As neck 18 is lowered into the playing position, the tapered plate strike edge 66 contacts the tapered latch edge 68 of latch 56 forcing latch 56 to move away from the proximal end 20 of the neck 18 far enough for the neck plate 40 to be lowered down flush with the body assembly. Once neck plate 40 clears latch 56, spring 72 returns the latch 56 to its normal position by the exertion of restorative force. Latch edge 74 holds neck plate 40 securely to the guitar body assembly 38 while safety lip 62 is seated in safety groove 60 so as to ensure that latch 56 does not accidentally slide off neck plate 40 and release the neck 18. Releasable fasteners 76 are attached to the body assembly 38 by being inserted from the backward surface 16 of the guitar 10. In this embodiment, the releasable fasteners are thumb screws which pass through the body assembly back 78, through the guitar body 12, and then through the body assembly front 80. In this embodiment, each of the releasable fasteners 76 is removably screwed into a threaded releasable fastener receptacle 58 on neck plate 40. Releasable fasteners 76 are tightened by hand until the neck plate 40 and body assembly 38 are held tightly together. This tightening relieves and then eliminates any forces on latch edge 74, safety lip 62, attachment edge 54, and safety groove 60. Although the body assembly 38 is depicted here as a separate assembly attached to guitar 10, the functions provided by the body assembly 38 could be provided as an integral part of the guitar body if the body is constructed of a material of sufficient strength to withstand the forces acting on the body assembly 38 resulting from the tension of the guitar strings 24.

Disassembly of the guitar 10 and storage of the neck 18 in the guitar body 12 is the mere reverse of the assembly description above and a simplified description is as follows: Releasable fasteners 76 are released from neck plate 40 whereby latch 56 continues to hold the guitar neck 18 in place by attachment edge 54 of neck plate 40. Neck 18 is then depressed slightly to return it to the playing position momentarily which allows safety lip 62 to move out of safety groove 60 thereby allowing latch 56 to be depressed at depression point 64, so as to release neck 18. Although the neck 18 can then be separated from the guitar body 12, one end of the strings 24 remains attached to the top of the neck and the other end of strings 24 remains attached through the bridge 76 to the tuning devices on the guitar body 12.

Although releasable fasteners 76 are described here as thumb screws for securing neck 18, the actual securing of the neck plate 40 flush against the body assembly 38 can be accomplish by a number of different releasable fasteners such as spring paws, adjustable screw latches or cam tightening devices as long as the neck can be routinely and repeatedly detached and reattached. Once the releasable fasteners 76 are tightened, the neck 18 is securely fastened to the guitar and ready for use.

Figure 4A:
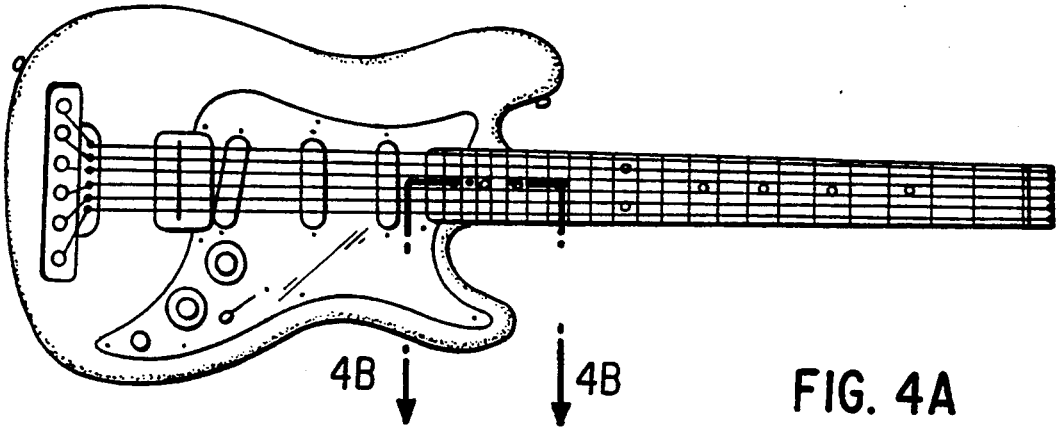
FIG. 4A illustrates a top plan view of a guitar according to the present invention.
Figure 4B:
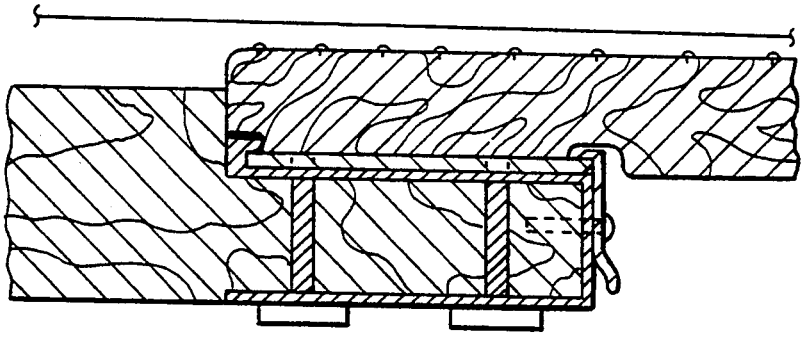
FIG. 4B illustrates a cross sectional view of the embodiment shown in FIG. 4A taken along section lines of FIG. 4A.

Additionally, FIGS. 4A and 4B show an embodiment of the invention without a safety groove.

Figure 5:
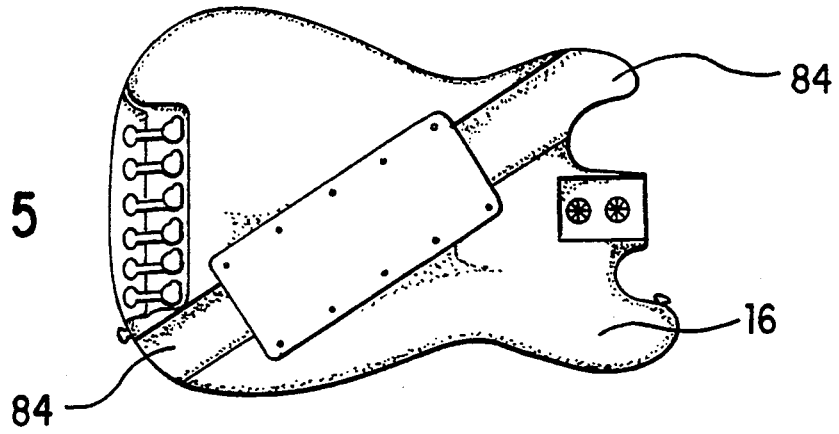
FIG. 5 illustrates a bottom plan view of a guitar according to the present invention in its disassembled state showing an empty diagonally arranged storage cavity channel.
Figure 6:
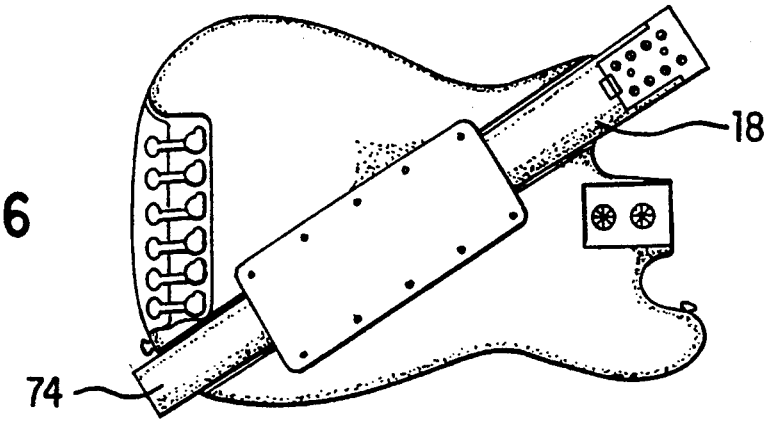
FIG. 6 illustrates a bottom plan view of a guitar according to the present invention in its disassembled state with the neck stored within the diagonally arranged storage channel of the guitar body.

Referring now to FIGS. 5 and 6, the neck 18 is shown separated from guitar body 12 and can be reversed to a position where the distal end 74 of the neck 18 can be inserted into the diagonally arranged storage cavity 84 on the backward surface of the guitar. Arranging the storage cavity diagonally within the guitar allows the instrument to be stored in a shorter, more compact space in contradistinction to guitars whose necks fold parallel to their deployed axis. Moreover, the full length of the neck is accommodated in the cavity without reducing the integrity of the neck by folding.

Figure 7:
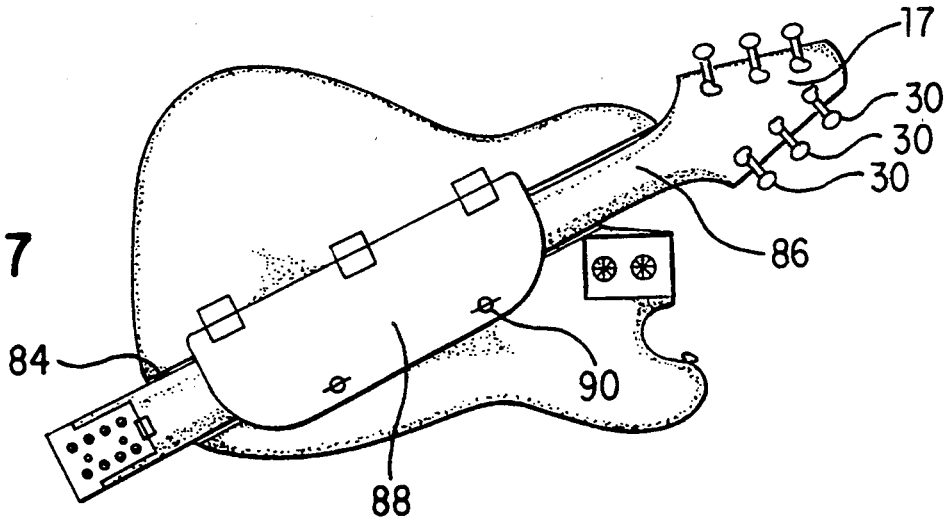
FIG. 7 illustrates a bottom plan view of another embodiment according to the present invention in its disassembled state with a neck having a headstock and string tuners stored within the diagonally arranged storage channel.

FIG. 7 shows another embodiment of the invention having a full neck 86 complete with headstock 17 and tuning devices 30. The resulting longer neck is similarly stored in the diagonally arranged storage cavity 84, however the full neck 86 is not slipped in to the cavity 84, as the previous embodiment, but is placed into the cavity 84 after opening the hinged storage cavity cover 88. After the neck is placed into the storage channel 84, the cover 88 is then closed and fastened to the body with twist fasteners 90. The storage cavity cover 88 not only secures the neck for transport but also provides additional bracing for the body during transport.

Figure 8:
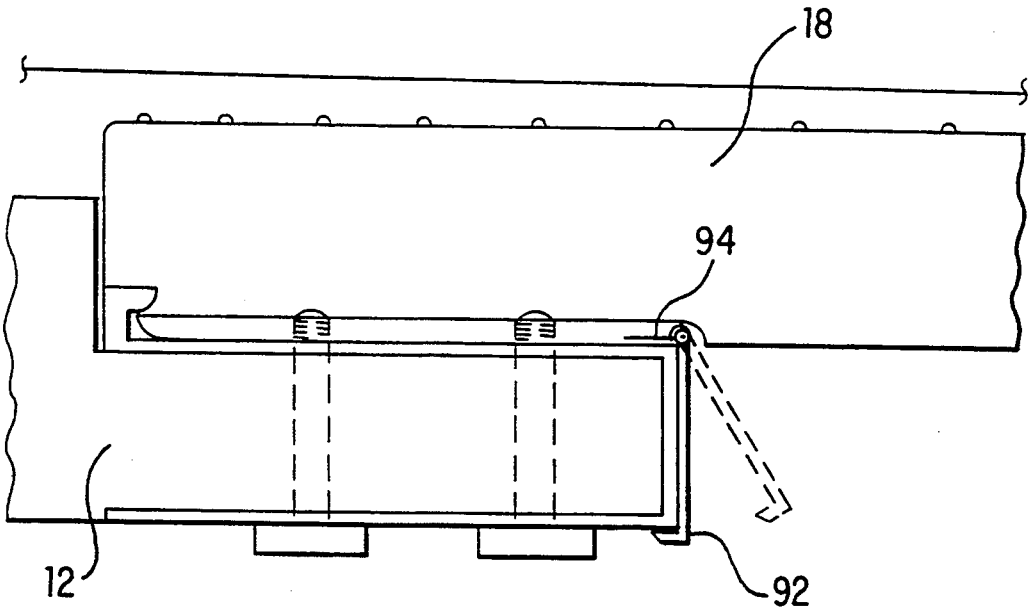
FIG. 8 illustrates a partial cross sectional view of another embodiment of the quick-release neck clamp described in FIG. 3 above.

FIG. 8 shows an additional embodiment of the connector in which the initial restraint of the neck 18 to the body 12 is by a spring-loaded latch 92 which is attached to the neck plate 40 or to the neck 18. When the neck 18 is lowered into position the attachment edge of the spring-loaded latch 92 slides over the end of the connector and latches the neck onto the body. The releasable fasteners are then inserted as before and the neck is secured for playing. The spring 94 on the latch causes the latch to attempt to fold toward the proximal end of the neck against the neck and out of the way when the neck is placed in the storage cavity in the guitar body for transport.

Figure 9:
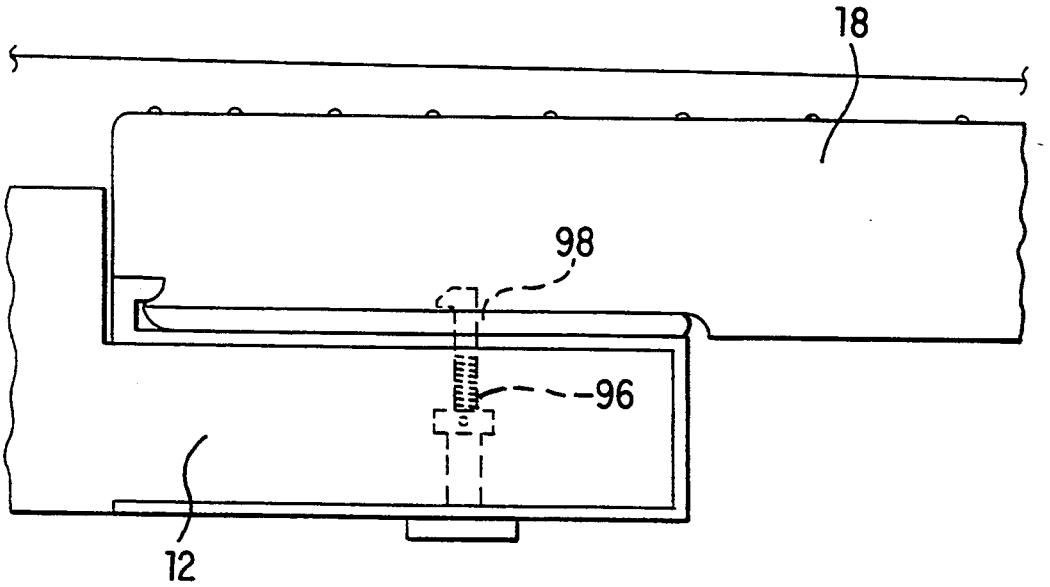
FIG. 9 illustrates a partial cross sectional view of another embodiment of the quick-release neck clamp according to the invention described in FIG. 3 above.

FIG. 9 shows an embodiment of the connector in which the releasable fastener acts as both an initial and as a primary attachment device. In this embodiment, the releasable fastener is a spring loaded paw latch 96. As the neck 18 is lowered into position the tapered edge on the paw contacts the neck plate and forces the paw toward the distal end of the neck. The paw latch passes through the neck plate slot 98. Once the paw latch 96 clears the neck plate the paw latch snaps back toward the proximal end of the neck. The screw attached to the paw is then rotated to draw paw down and thereby cause the neck plate to be drawn down flush with the body. Further, as used herein, releasable fastener is any device which acts to tighten the quick-release neck clamp such as a tension latch, a tapered rotary latch or a cam tightening device. Although it is preferred that the releasable fasteners be manually activated, the releasable fasteners could be actuated by a tool such as a hex wrench or even a coin. The releasable fasteners should be capable of being routinely and repeatedly actuated so as to encourage the detachment and reattachment of the neck 18.

Figure 10:
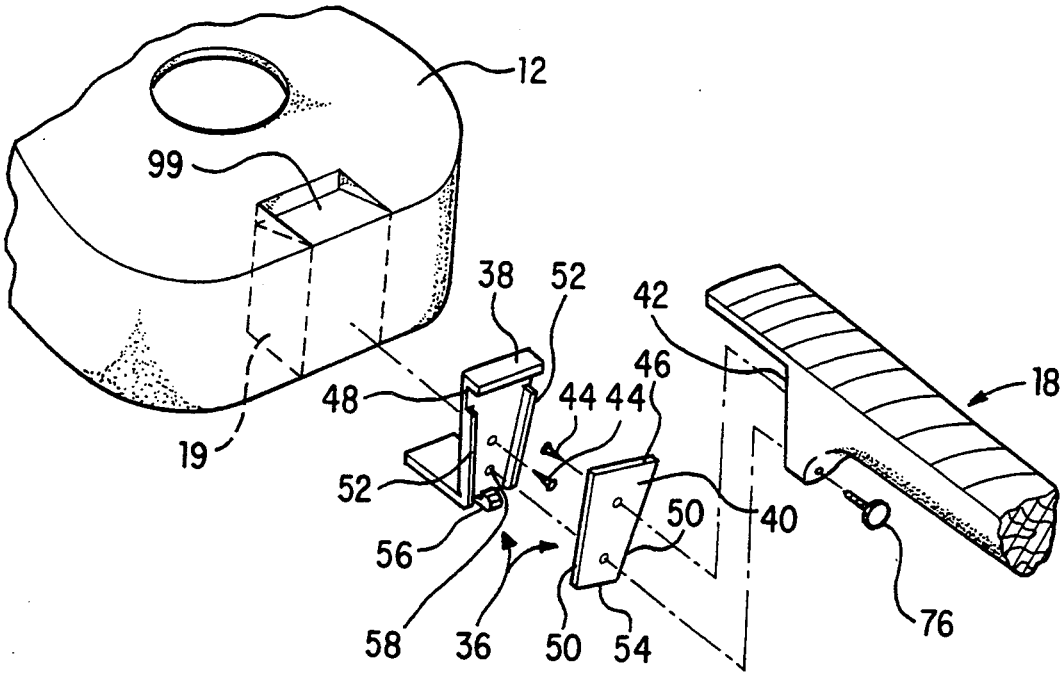
FIG. 10 illustrates a partial cross sectional exploded perspective view of another embodiment of the quick-release neck clamp according to the invention.

FIG. 10 shows that the neck 18 can be removed from and reattached to an acoustical guitar body 12 with the connector 36 orientated so that the alignment rails 52 are perpendicular to the plane defined by the strings. Connector 36 again includes the body assembly 38 and the neckplate 40. The neck plate 40 is fastened to the neck heel 42 with a plurality of wood screws 44. The neck plate 40 provides the initial anchoring and alignment point for positioning neck 18 for attachment. Plate heel 46 is inserted into the body assembly pocket 48 and the neck 18 is lowered into playing position. The alignment edges 50 of the necking plate 40, in conjunction with alignment rails 52 of body assembly 38, ensure that the neck 18 is properly aligned with respect to the guitar body each time the neck is attached. Attachment edge 54 is the initial securing point of the neck to the guitar, and once initially attached, the neck 18 is held in place by latch assembly 56. The attachment edge 54 should be strong enough to be able to withstand the bending or shear forces placed on it from the latch 56 as a result of the tension of guitar strings 24. Releasable fastener receptacles 58 are the primary securing points, which hold the neck plate 40 tightly to the guitar body assembly 38 when the instrument is fully assembled for playing or while it is not otherwise disassembled. One or more releasable fastener receptacles 58 can be used. Although the neck plate 40 is depicted in FIG. 10 as a separate steel plate joined to the neck 18 with wood screws 44, the functions provided by the neck plate 40 in this acoustical embodiment can also be integrated into the design of the neck if the neck is constructed of materials which provide sufficient strength in the critical areas of attachment to the body assembly 38. For example, if the neck were to be constructed out of materials such as metal alloys, composites, or similar wood and metal combinations, the operative surfaces could be milled or machined directly onto or into the neck 18.

Body assembly 38 is attached to the body of the guitar 12 by a plurality of screws 44 and block 19. In this acoustical embodiment, block 19 is preferably made of wood. However, block 19 can be made of any suitable material such as fiberglass or plastic. Block 19 has a finger board recess 99 which allows the proximal end of the neck 18 to swing toward the body of the guitar 12 sufficiently to allow for assembly and disassembly. In this embodiment, body assembly pocket 48 is also the initial anchoring and alignment point for the neck plate 40. Body assembly pocket 48 is a grooved shaped opening that the plate heel 46 is inserted into. Alignment rails 52 insure that alignment edge 50 of the neck plate 40 and consequently neck 18 is always positioned correctly when lowered for attachment into the playing position. Latch 56 provides the initial restraint of the neck plate 40 to the body assembly 38.

Figure 11:
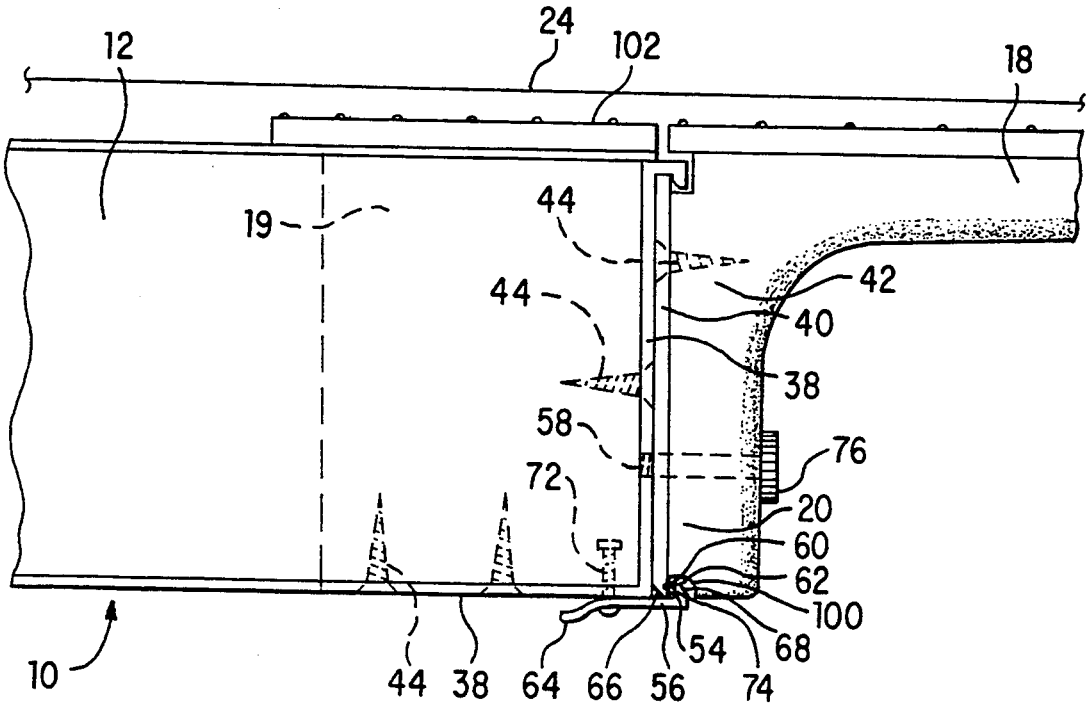
FIG. 11 illustrates a partial cross sectional view of still another quick-release neck clamp according to the invention.

FIG. 11 shows that safety groove 60 of this embodiment is also an elongated indentation in the neck plate 40 which allows the raised lip 62 on the edge of the latch 56 to mate in safety groove 60. When the latch 56 is engaged, and the releasable fastener receptacles 58 are not engaged, the tension from the guitar strings 24 exerts a force which tends to pull the neck plate 40 away from the guitar body assembly 38. The safety lip 62, seated in the safety groove 60, prevents the latch 56 from slipping off the neck plate 40 and accidentally releasing the neck 18. Only by deliberately holding neck 18 down into the playing position and simultaneously depressing the latch 56 at depression point 64 is the safety lip 62 free to move out of the groove 60. Thus, the neck plate 40 and neck 18 are consequently released and are thereby free to move away from the guitar for easy disassembly and storage. Plate strike edge 66 on neck plate 40 is a tapered edge used in conjunction with the latch strike edge 68. As neck 18 is lowered into the playing position the tapered plate strike edge 66 contacts the tapered latch edge 68 of latch 56 forcing latch 56 to move away from the proximal end 20 of the neck 18. The latch 56 is thereby moved far enough away from the neck plate 40 to be ready to snap onto attachment edge 54. Once neck plate 40 clears latch 56, spring 72 returns the latch 56 to the normal non-depressed position. The latch recess 100 allows the latch 56 to move sufficiently during assembly and disassembly. Latch edge 74 holds neck plate 40 securely to the guitar body assembly 38, while safety lip 62 seated in safety groove 60 ensures that latch 56 does not accidentally slide off neck plate 40 and release the neck 18. Releasable fastener 76, which in this acoustical embodiment, is a thumb screw attached to the heel of the neck, is brought into contact with the neck plate and screwed into a threaded releasable fastener receptacle 58 on the body assembly 38. The thumb screw is tightened by hand until the neck plate 40 and body assembly 38 are held tightly together thereby eliminating any forces on latch edge 74, safety lip 62, attachment edge 54, and safety groove 60. Although the body assembly 38 is again depicted here as a separate assembly attached to guitar 10, the functions provided by the body assembly 38 could also be provided in this embodiment as an integral part of the guitar body if the body were constructed of material of sufficient strength to withstand the forces acting on neck plate 40 and the body assembly 38 resulting from the tension of the guitar strings 24.

Disassembly of the acoustical guitars shown in FIGS. 10 and 11 is also the reverse of the assembly description above. Briefly, the thumbscrew is released from body assembly 38 whereby latch 56 continues to hold the guitar neck 18 in place by attachment edge 54 of the neck plate 40. Neck 18 is then depressed slightly to return it to the playing position momentarily, which allows safety lip 62, of latch 56, to move out of safety groove 60 thereby allowing latch 56 to be depressed at depression point 64, which results in the releasing of neck 18. Although the neck 18 is thereby separated from the guitar body 12, one end of the strings 24 remains attached to the top of the neck and the other end of strings 24 remains attached to the bridge 28. Static finger board portion 102 remains attached to the guitar body 12. The neck 18 is stored in a storage cavity provided in the guitar body 12.

Figure 12:
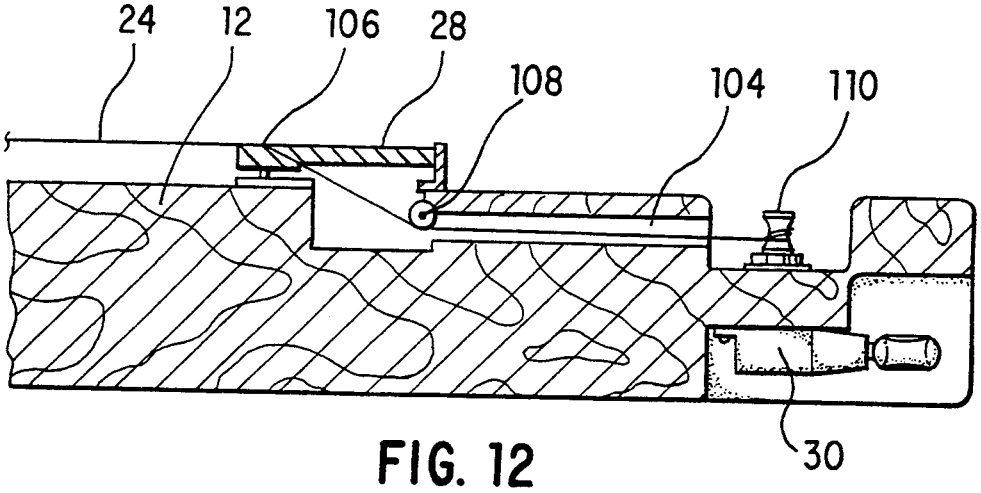
FIG. 12 illustrates a partial cross sectional view of a guitar with string tunnels according to an embodiment of the invention.

FIG. 12 shows a cross section of a guitar body 12 having at least one string tunnel 104 which acts to enclose a portion of the string 24 and ruggedize the guitar. String 24 passes over a string saddle 106 of bridge 28. String 24 then passes over a string roller 108 and into a string tunnel 104. After emerging from the string tunnel 104, string 24 is wound on a shaft 110 of tuning device 30.

Figure 13:
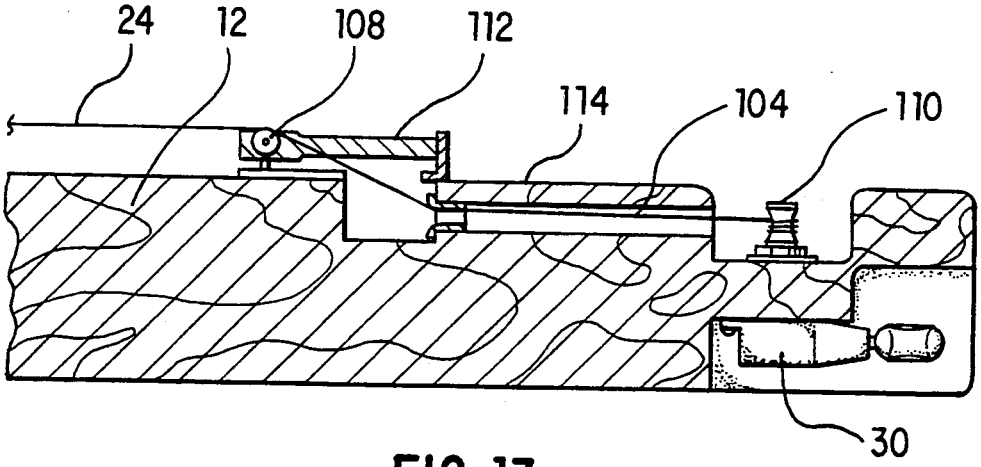
FIG. 13 illustrates a partial cross sectional view of a guitar with string tunnels according to another embodiment of the invention.

FIG. 13 shows a cross section of another guitar body 12 having at least one string tunnel 104. In this embodiment, string 24 first passes over a string roller 108 of roller bridge 112. String 24 then passes through string guide 114 and into string tunnel 104. As in the embodiment shown in FIG. 12, after emerging from the string tunnel 104, the string 24 is wound on shaft 110 of tuning device 30.

Figure 14:
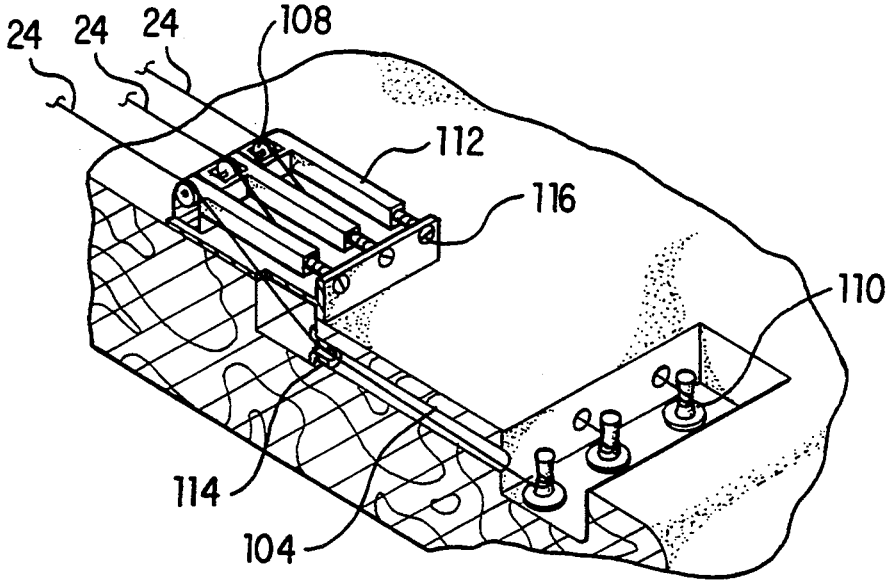
FIG. 14 illustrates a partial cross sectional perspective view of a guitar according to the invention described in FIG. 13 above.

FIG. 14 shows a perspective cross section of the embodiment shown in FIG. 13. A plurality of strings 24 is shown. Each of the strings 24 passes over a string roller 108 of roller bridge 112, through a string guide 114 and then into a string tunnel 104. Each string roller 108 is longitudinally displaceable by moving intonation adjuster 116.

While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the appended claims.

What is claimed is:

1. A musical instrument, comprising:

a neck;

a body having a longitudinal axis, said body comprising:

a storage cavity, formed within said body, which can hold said neck at an angle to said longitudinal axis; and a plurality of string tunnels formed within said body; and a quick-release neck clamp, adjacent said neck and said body, said quick-release neck clamp comprising:

a neck plate attached to said neck;

a body assembly, attached to said body, said body assembly comprising an elongated body assembly pocket formed on said body assembly; and at least one releasable fastener adjacent said neck plate and said body assembly wherein said body further comprises a front surface formed on said body, said front surface defining a front surface plane, and said elongated body assembly pocket defines an axis along the elongation that is parallel to said front surface plane.

2. The musical instrument of claim 1 wherein said musical instrument is a guitar.

3. The musical instrument of claim 2 wherein said guitar is an electrical guitar and wherein said at least one releasably fastener is attached to said body assembly and is removably attached to said neck plate.

4. The musical instrument of claim 2 wherein said guitar is an acoustical guitar, and wherein said at least one releasably fastener is attached to said neck plate and is removably attached to said body assembly.

5. The musical instrument of claim 1 wherein said quick-release neck clamp further comprises a latch connected ti said body assembly.

6. The musical instrument of claim 5 wherein said neck plate further comprises a plate strike edge formed on said neck plate and a safety groove formed on said neck plate, and wherein said latch further comprises a latch strike edge formed on said latch and a safety lip formed on said latch which can fit in said safety groove of said neck plate.

7. The musical instrument of claim 1 wherein said at least one releasably fastener is a spring loaded paw latch.

8. The musical instrument of claim 1 wherein said body further comprises a back surface formed on a second side of said body, said back surface defining a back surface plane, and a plurality of string tuning devices located between said front surface plane and said back surface plane.

9. A musical instrument, comprising:

a neck;

a body having a longitudinal axis, said body comprising a cavity, formed within said body, which can hold said neck; and a quick-release neck clamp adjacent said neck and said body, said quick-release neck clamp comprising:

a neck plate attached to said neck;

a body assembly attached to said body, said body assembly comprising an elongated body assembly pocket formed on said body assembly; and at least one releasable fastener adjacent said neck plate and said body assembly wherein said body further comprises a front surface formed on said body, said front surface defining a front surface plane, and said elongated body assembly pocket defines an axis along the elongation that is parallel to said front surface plane.

10. The musical instrument of claim 9 wherein said musical instrument is a guitar.

11. The musical instrument of claim 10 wherein said guitar is an electrical guitar, and wherein said at least one releasably fastener is attached to said body assembly and is removably attached to said neck plate.

12. The musical instrument of claim 10 wherein said guitar is an acoustical guitar, and wherein said at least one releasably fastener is attached to said neck plate and is removably attached to said body assembly.

13. The musical instrument of claim 9 wherein said quick-release neck clamp further comprises a latch connected to said body assembly.

14. The musical instrument of claim 13 wherein said neck plate further comprises a plate strike edge and a safety groove, and wherein said latch further comprises a latch strike edge and a safety lip which can fit in said safety groove of said neck plate.

15. The musical instrument of claim 13 further comprising a plurality of string tunnels formed within said body.

16. The musical instrument of claim 9 wherein said body further comprises a back surface formed on a second side of said body, said back surface defining a back surface plane, and a plurality of string tuning devices located between said front surface plane and said back surface plane.

17. A musical instrument comprising:

a neck;

a body having a longitudinal axis, said body comprising a cavity, formed within said body, which can hold said neck; and a quick-release neck clamp adjacent said neck and said body, said quick-release neck clamp comprising:

a neck plate attached to said neck;

a body assembly attached to said body, said body assembly comprising a body assembly pocket formed on said body assembly; and at least one releasable fastener adjacent said neck plate and said body assembly wherein said at least one releasable fastener is a spring loaded paw latch.

18. The musical instrument of claim 17 wherein said body further comprises a front surface formed on a first side of said body, said front surface defining a front surface plane, and said body assembly pocket is an elongated body assembly pocket defining an axis along the elongation, said axis of said body assembly pocket being parallel to said front surface plane.

19. The musical instrument of claim 17 wherein said body further comprises a front surface formed on a first side of said body, said front surface defining a front surface plane, a back surface formed on a second side of said body, said back surface defining a back surface plane, and a plurality of string tuning devices located between said front surface plane and said back surface plane.

20. A musical instrument, comprising:

a neck;

a body connected to said neck comprising a plurality of string tunnels formed within said body; and a plurality of tuning devices, each of said plurality of said tuning devices being mounted adjacent to one of the string tunnels and on said body.

21. The musical instrument of claim 20 wherein the musical instrument is a guitar.

22. The musical instrument of claim 21 wherein the guitar is an electrical guitar.

23. The musical instrument of claim 21 wherein the guitar is an acoustical guitar.

24. The musical instrument of claim 20 wherein said body further comprises a plurality of string saddles mounted on said body, each of said plurality of string saddles comprising a string roller attached to each of said plurality of string saddles.

25. The musical instrument of claim 20 wherein each of said plurality of string tunnels further comprises at least one string guide mounted within each of said plurality of string tunnels.

26. The musical instrument of claim 20 wherein said neck is connected to said body with a quick-release neck clamp that is mounted adjacent to said neck and said body, said quick-release neck clamp comprising a neck plate attached to said neck;

a body assembly attached to said body and comprising a body assembly pocket formed on said body assembly; and at least one releasable fastener adjacent said neck plate and said body assembly.

27. The musical instrument of claim 26 wherein said at least one releasable fastener is a spring loaded paw latch.

28. The musical instrument of claim 26 wherein said body further comprises a front surface formed on a first side of said body, said front surface defining a front surface plane, and said body assembly pocket is an elongated body assembly pocket defining an axis along the elongation, said axis of said body assembly pocket being parallel to said front surface plane.

29. The musical instrument of claim 20 wherein said body further comprises a front surface formed on a first side of said body, said front surface defining a front surface plane, and a back surface formed on a second side of said body, said back surface defining a back surface plane, and said plurality of string tuning devices are located between said front surface plane and said back surface plane.

* * * * *

UNITED STATES PATENT AND TRADEMARK OFFICE

CERTIFICATE OF CORRECTION

PATENT NO. : 5,353,672
DATED : October 11, 1994
INVENTOR(S) : Stewart

It is certified that error appears in the above-indentified patent and that said Letters Patent is hereby corrected as shown below:

Column 11, claim 1, line 30, begin a new paragraph before "wherein".
Column 11, claim 5, line 49, replace "ti" with --to --.
Column 11, claim 7, line 58, replace "releasably" with --releasable --.
Column 12, claim 9, line 12, begin a new paragraph before "wherein".

Signed and Sealed this

Twentieth Day of June, 1995

*Attest:*

Bruce Lehman

BRUCE LEHMAN

*Attesting Officer*

*Commissioner of Patents and Trademarks*